United States Patent [19]

Johnson

[11] Patent Number: 4,610,034

[45] **Date of Patent: * Sep. 9, 1986**

[54] SHOULDER PROTECTION DEVICE

[76] Inventor: Sam E. Johnson, 1519 Westbury Dr., Davison, Mich. 48423

[ * ] Notice: The portion of the term of this patent subsequent to Jun. 26, 2001 has been disclaimed.

[21] Appl. No.: 623,444

[22] Filed: Jun. 22, 1984

Related U.S. Application Data

[63] Continuation-in-part of Ser. No. 415,607, Sep. 7, 1982, Pat. No. 4,455,684.

[51] Int. Cl.[4] ..... A41D 13/00; B32B 3/10

[52] U.S. Cl. ..... 2/2; 2/2.5; 2/94; 428/131

[58] Field of Search ..... 2/2, 2.5, 45, 16, 268, 2/94; 428/131, 423.1

[56] References Cited

U.S. PATENT DOCUMENTS

| | | | |
|---|---|---|---|
| 3,257,666 | 6/1966 | Hoffman | 2/2 |
| 3,398,406 | 8/1968 | Waterbury | 2/2.5 |
| 3,550,159 | 12/1970 | Alarco | 2/2 |
| 3,770,560 | 11/1973 | Elder et al. | 428/131 X |
| 3,809,600 | 5/1974 | Larson | 428/131 |
| 4,121,005 | 10/1978 | Roberts | 428/131 |
| 4,272,847 | 6/1981 | Buhler | 2/2 |
| 4,455,684 | 6/1984 | Johnson | 2/2 |

*Primary Examiner*—Werner H. Schroeder
*Assistant Examiner*—J. L. Olds
*Attorney, Agent, or Firm*—Harness, Dickey & Pierce

[57] ABSTRACT

A thin flexible lightweight shoulder protection device for attachment to a shooter's garments to absorb rifle or similar firearm recoil loads. The device includes a flexible cover portion within which an energy absorbing pad is retained. One form of the pad includes a flexible sealed envelope which houses an internal solid polyurethane elastomer matrix which provides the device with its damping or energy absorbing capability. Alternate embodiments of the pad comprise an elastomer matrix formed with periodic recesses or depressions in the user facing surface, or with hollow compression chambers within the matrix, to provide an improved energy absorbing internal geometry to the device. Retention means are provided for removably locating and securing the device at desired garment locations.

36 Claims, 18 Drawing Figures

SHOULDER PROTECTION DEVICE

CROSS-REFERENCE TO RELATED APPLICATION

This application is a continuation-in-part of co-pending application Ser. No. 415,607, filed Sept. 7, 1982, now U.S. Pat. No. 4,455,684 entitled "SHOULDER PROTECTION DEVICE".

BACKGROUND AND SUMMARY OF THE INVENTION

The present invention relates to shoulder protection devices, and more particularly, to a shoulder protection device particularly suited to absorb impact loads or forces directed to the shoulder area of a user during the discharge from shoulder-supported firearms such as rifles and the like.

As is well knowm, impact loads or forces caused by the rapid release of kinetic recoil energy of a shoulder-supported firearm as it decelerates against the shoulder can be a nuisance to the user of such firearms. Indeed, the faster the deceleration, the greater the shock or impact load to the shoulder. Continuous and repeated use of heavy shoulder-supported firearms such as shotguns and rifles can thus be distressful, fatiguing and often painful for a marksman or hunter due to repeated and unavoidable recoil impact loads directed to the shoulder area. For this reason, to enable the user to shoot with more comfort and with less fatigue, it is often desirable to provide the user's shoulder with some sort of protective padding or covering to reduce the rate of firearm deceleration and at least partially absorb such loads.

There exist many types of energy absorbing devices or recoil pads intended to reduce the level of impact loads directed to a user's shoulder due to firearm recoil. Various padded outer garments, hunting vests and shoulder pad arrangements have been devised having energy absorbing materials which offer the user some means of protection against such recoil loads. However, since the energy absorbing material has a substantial influence on the rate of deceleration of the firearm, and thus the magnitude of impact load on the shoulder, the effectiveness of such devices depends upon the type of absorbing material utilized. Materials which have heretofore been used in such applications include felt, hair, layers of cloth, leather, hard rubber, sponge rubber, and foamed plastic. However, firm materials such as leather or hard rubber do not deform very quickly when subjected to a rapidly moving firearm. Such materials thus act more like a hard surface—they stop the firearm very quickly, and result in a sharp deceleration of the firearm, as well as substantial shock loading of the shoulder. Other materials such as sponge rubber, felt, hair and layers of cloth have interconnected air spaces which permit displacement and a flattening or bottoming out of the material, whereupon they also behave more like a hard surface. While plastic foam offers an improvement over the previous materials, foam plastic material will exhibit the same bottoming out behavior in certain applications. Such behavior can be reduced by increasing the thickness of protective pads incorporating such materials. However, larger pad thickness is undesirable since it contributes to increased bulk and general profile of a shoulder protection device.

It is, therefore, desirable to provide a shoulder protection device for absorbing firearm recoil loads which allows the firearm to decelerate over a longer time period than that possible with prior devices, with an attendant smaller shock or impact load imparted to the shoulder of the user. It is moreover desirable to provide such a device having an energy absorbing material which allows for a relatively thin low profile protective pad which does not bottom out and act like a hard surface during firearm use.

The present invention is intended to satisfy the above desirable features through the provision of several embodiments of a new and improved shoulder protection device in the form of a thin flexible protective pad having a cover portion, an internal envelope and a solid internal energy absorbing thermoplastic elastomer matrix within the internal envelope. The firmness and composition of the matrix is such that it deforms quickly, allows for enhanced deceleration periods, and yet generates a restoring force so that it does not bottom out and act like a hard surface during use. An alternate form of solid elastomer matrix eliminates the need for the internal envelope, and can be molded with a plurality of relief areas or recesses of various profiles in the surface which faces or abuts the user's shoulder, or with a series of non-communicating internal compression chambers, to yield an energy absorbing pad with an enhanced three-dimensional deformation or energy absorbing geometry. The device includes retention means located on the external cover which allows the device to be removably retained at desired locations on a user's garment.

The above and other features of the invention will become apparent from a reading of the detailed description of the preferred embodiments, which make reference to the following set of drawings.

DETAILED DESCRIPTION OF THE PREFERRED EMBODIMENT

Figure 1:
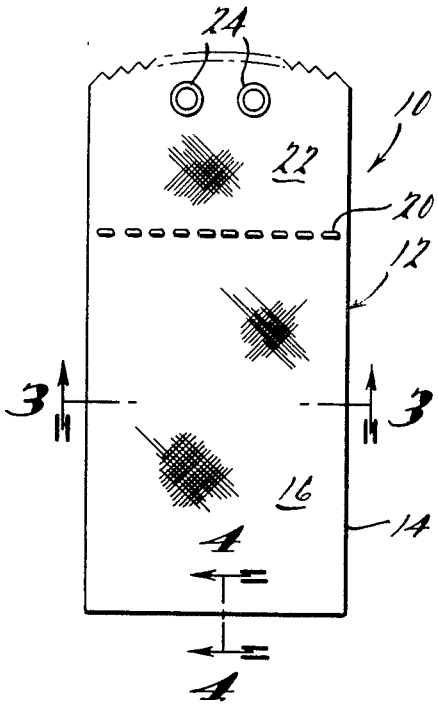
FIG. 1 is a frontal view of a shoulder protection device in accordance with one embodiment of the present invention.

Referring now more specifically to the drawings, a shoulder protection device in accordance with one embodiment of the present invention is indicated generally by reference numeral 10. The device 10 includes a cover portion 2 which is formed to define an external envelope 14 having a frontal face 16, a back face 18, and a thickness T. In the preferred embodiment, the cover portion 12 is formed from a single elongated piece of stretch cloth which is folded over upon itself and stitched together longitudinally along its edges 19, as well as laterally along location 20 to define the external envelope 14. Such an operation also results in the formation of a tongue portion 22. A pair of eyelets 24 are provided in tongue portion 22 through which the device may be removably attached to a garment as described more fully hereinafter.

Figure 3:
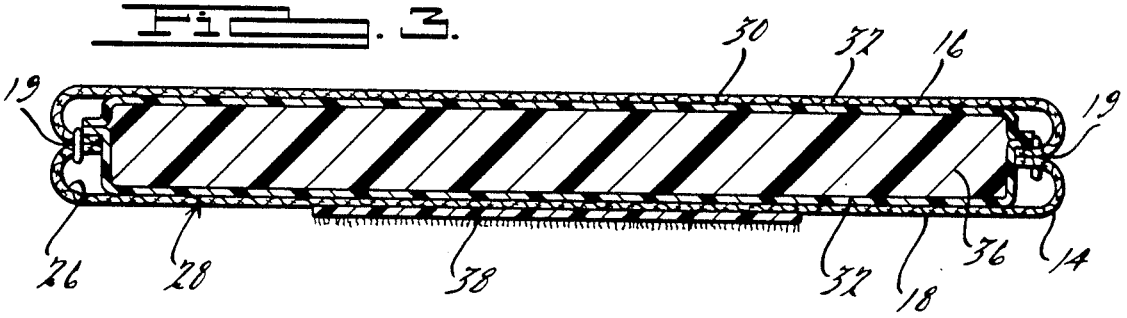
FIG. 3 is a sectional view taken in the direction of Line 3—3 of FIG. 1.
Figure 4:
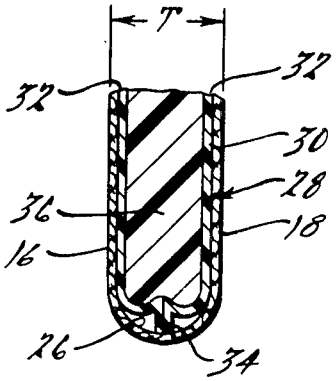
FIG. 4 is a partial sectional view taken in the direction of Line 4—4 of FIG. 1.

When formed in this manner, the external envelope 14 defines an enclosed recess 26 within which an energy absorbing pad 28 operative to absorb recoil forces is retained. The energy absorbing pad 28 includes an internal sealed envelope 30 formed by the mated assembly of a pair of complementary shaped flexible generally rectangular thin sheets of water resistant plastic film 32, which, in the preferred embodiment, are mated at their outer peripheral edges 34 by a heat sealing process. As shown in FIGS. 3 and 4, disposed within and contained by the internal envelope 30 is a solid thermoplastic elastomer matrix 36 which operates to provide 10 with its energy absorbing capability.

The matrix 36 is composed of a very soft solid polyurethane elastomer having many of the general properties normally associated with a rubber-like material: it stretches rapidly reaching a high elongation; it retracts rapidly; it returns to and retains its original fabricated shape after being deformed; it exhibits a tensile strength and stiffness when fully stretched and will thus fracture. When subjected to the motion of a rapidly moving firearm, the solid elastomer deforms quickly, yet generates a restoring force of its own so that it does not bottom out and thus act like a hard surface. A form of the elastomer which is preferable for use for the internal matrix 36 is "Action Elastomeric" manufactured by Action Products, Inc. of Hagerstown, Md. "Action Elastomeric" is the trademark of a very soft polyurethane elastomer produced by Action Products, Inc. having elongation ranges of from approximately 300 to 1,200 percent, and having a specific gravity range of from approximately 1.02 to 1.03.

Figure 2:
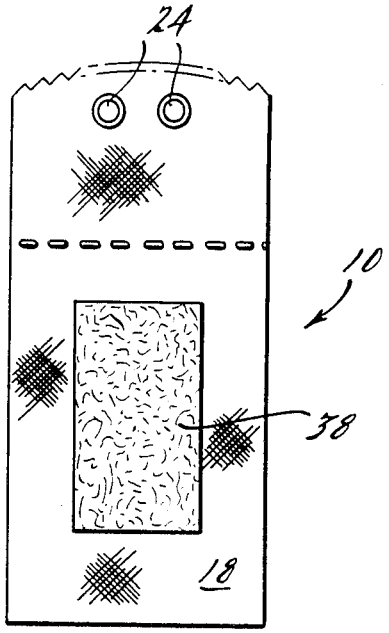
FIG. 2 is a rear view of the device shown in FIG. 1.

The device 10 may be removably secured at a desired location on a user's garments by way of a safety pin passed through the eyelets 24 in tongue 22. Alternatively, the device 10 may be secured at a variety of garment locations by using Velcro fasteners. To facilitate attachment in this manner, the device 10 can be provided with a Velcro pad 38 located along the back face 18 of external envelope 14 as shown in FIGS. 2 and 3. Once attached to the user's garment, the device 10 is utilized by seating the butt of a firearm against the front face 16 of external envelope 14 and discharging the firearm in a normal manner. Such discharge will cause the firearm to recoil and impart an impact load against the front face 16 of envelope 14. This load will in turn cause the pad 28 to compress in the direction of recoil against the user's body. Additionally, the high deformability of the matrix 36, as well as the flexible nature of internal envelope 30 and external envelope 14, allow the pad 28 to expand or bulge in a direction generally normal to the direction of recoil. The combination of these modes of deformation thus gives the pad 28 a high damping or energy absorbing characteristic well-suited for dissipating firearm recoil loads.

It has been found that a device 10 suitable for trap or skeet shooting weapons can be provided with an overall thickness T of approximately $\frac{1}{4}$ inches. For heavier gauge weapons, such as a 300 Winchester Magnum or 458 Winchester Magnum, a device 10 with a thickness T of approximately $\frac{1}{2}$ inches is preferable. For very light recoiling guns, such as a Remington Model 1100, or light recoiling rifles, such a s calibers 22–250, 223 or 243, it has been found that a device 10 with a thickness T of approximately $\frac{1}{8}$ inches is suitable for providing adequate recoil absorption. It should be noted that the preception of recoil forces is highly subjective, and that such forces are perceived differently from one shooter to another. For this reason, it may be desirable to provide a device 10 with a thickness T of up to $\frac{3}{4}$ inches in certain applications or for particular users. Indeed, a device 10 having such a thickness T may be desirable in bench rest or prone shooting applications, where a user's shoulder is situated so that it fails to give upon firearm discharge as readily as if the user were in a standing position.

Another form of elastomer which is suitable for use for the internal matrix 36 is "Eura-Lite". "Eura-Lite" is the trademark of a soft polyurethane elastomer produced by Detroit Rubber, Inc. of Detroit, Michigan having an elongation range of from approximately 565 to 590 percent for a matrix of 1 inch in width, 4 inches long and 3/16 inches thick, a hardness of approximately 20 on the 00-Shore durometer scale, using a durometer manufactured by Shore Instrument & Mfg. Company of Jamaica, N.Y., and a specific gravity of approximately 1.033. The use of Eura-Lite for the internal matrix 36 provides for additional manufacturing advantages because its characteristics eliminate the need for providing internal envelope 30, and further enable it to be molded into desired geometries and die cut to form the matrix 36. This results in a reduction in manufacturing costs over pads 28 utilizing an Action Elastomeric internal matrix 36, which must be poured into and retained by internal envelope 30 to yield pad 28.

In connection with the above, and as described more fully hereinafter, it has also been found that solid polyurethane elastomer matrices can be provided with a range of durometer values and machined or formed into pad geometries having recoil force absorption characteristics in accordance with the invention. In this regard, the device 10 can be provided with an internal solid matrix 36 comprised of a solid polyurethane elastomer having durometer values of from 15 to 35 on the 00-Shore durometer scale. However, solid polyurethane elastomer matrices having durometer values of from approximately 20 to 35 on the 00-Shore scale should preferably be provided with recesses or a relief grid along the back or user facing surface for optimum recoil absorption. In addition, it has been found that a solid polyurethane elastomer matrix having durometer values of from approximately 35 to approximately 80 on the 00-Shore durometer scale, or from 0 to approximately 20 on the A-Shore durometer scale, are suitable for use with the device 10 by providing the matrix with a series of discrete non-communicating through channels or apertures extending through the matrix as described more fully below.

Figure 5:
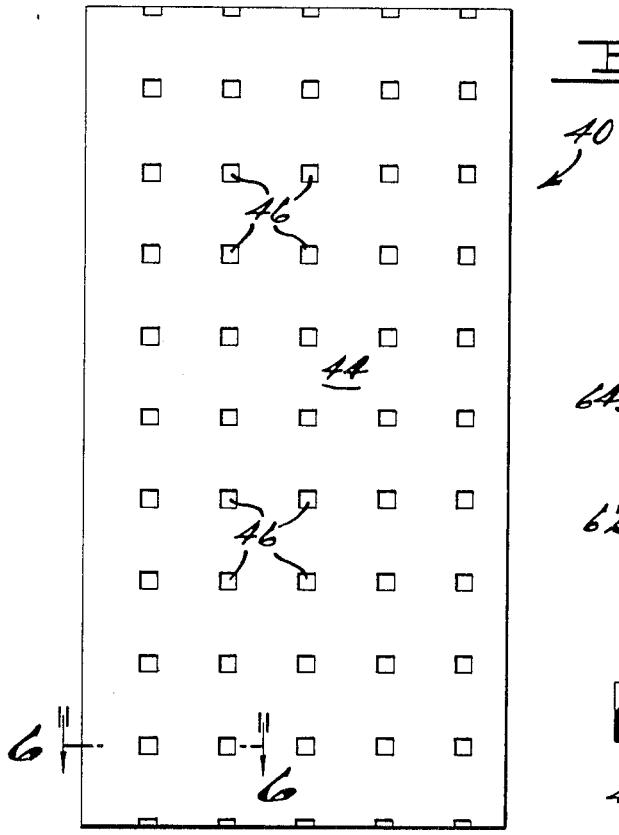
FIG. 5 is an elevational view of a portion of an alternate embodiment of the invention.
Figure 6:
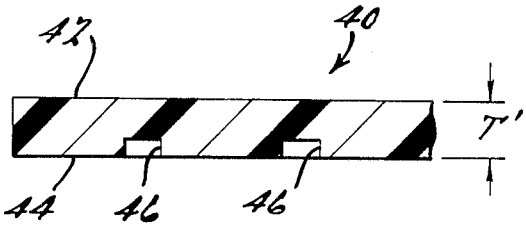
FIG. 6 is a partial sectional view taken in the direction of Line 6—6 of FIG. 5.
Figure 7:
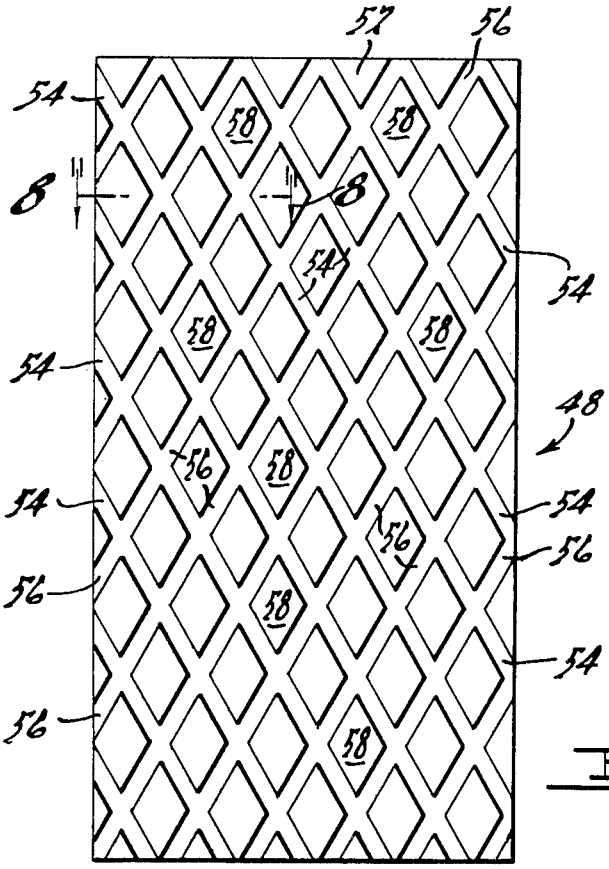
FIG. 7 is an elevational view of a portion of a further embodiment of the invention.
Figure 8:
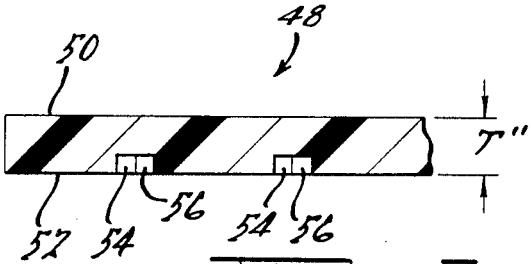
FIG. 8 is a partial sectional view taken in the direction of Line 8—8 of FIG. 7.
Figure 10:
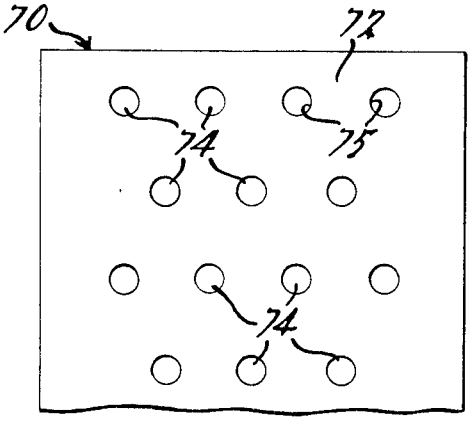
FIG. 10 is a schematic view of a portion of another embodiment of the invention.
Figure 11:
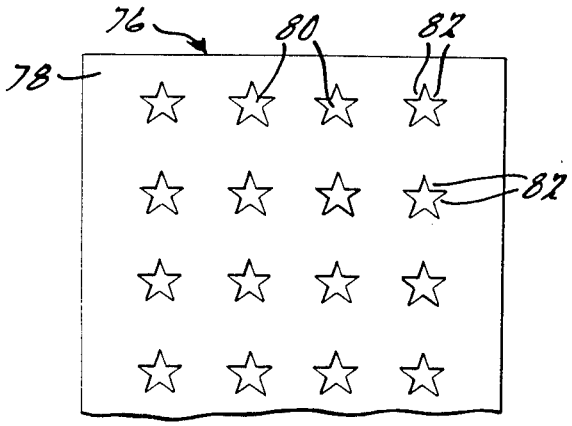
FIG. 11 is a schematic view of a portion of yet another embodiment of the invention.

Two embodiments of internal solid elastomer matrices formed from the above-described Euro-Lite elastomer are shown in FIGS. 5 through 8. More particularly, FIGS. 5 and 6 illustrate a solid elastomer matrix 40 of the previously described material characteristics and defining a top surface 42, a bottom surface 44 operative to face the user, and a thickness T'. The bottom surface 44 is also formed with a plurality of periodically spaced generally square depressions or recesses 46 as shown in FIG. 5. The depth of each individual recess 46 is less than ½ that of the overall thickness T' of the matrix 40 as shown in FIG. 6. A further embodiment of a solid elastomer matrix is shown in FIGS. 7 and 8 at 48. In this embodiment, the matrix 48 defines a top surface 50, a bottom surface 52 operative to face the user's shoulder, and possesses a thickness T''. As illustrated most readily in FIG. 7, the bottom surface 52 is formed with a first set of spaced parallel elongated channels 54 which are rectangular in cross-section. A second set of spaced parallel elongated channels 56 are also formed in the bottom surface 52, and extend therealong to intersect the first set of channels 54 and cooperatively define therewith a diamond shaped relief grid in bottom surface 52 having a depth which is less than ½ of thickness T''. The relief grid effectively defines a series of generally diamond shaped ribs or projections spaced periodically about the bottom surface 52 of the matrix 48. The relief grid of matrix 48 can be expeditiously formed by inserting an expanded metal grid within the bottom interior surface of the forming mold utilized to form the solid elastomer matrix 48 during its manufacturing process.

Each of the embodiments of the invention illustrated in FIGS. 5 through 8 and described hereinabove possess additional advantages over the previously described embodiment by reason of the existence of the periodic relief grid formed in their respective bottom surfaces 44 and 52. More particularly, the presence of the relief grid in each of these embodiments provides additional modes of deformation for the respective matrixes 40 and 48, and thus yields enhanced damping or energy absorbing characteristics. Thus, for example, with matrix 40, the application of an impact load against the top surface 42 will result in the expansion or bulging of the matrix material into the volume of the periodically spaced recesses 46 both in the direction of the impact load and in a direction normal thereto. In the case of matrix 48, a similar expansion and bulging phenomenon will take place relative to channels 54 and 56. More particularly, in this latter embodiment of the invention, matrix material disposed between each channel 54 and 56 and the top surface 50 of the matrix 48 possesses the ability to expand in the direction of an impact load into an associated channel 54 or 56. On the other hand, matrix material disposed within each of the diamond shaped projections 58 possesses the ability to expand normally of the direction of impact loading and into the adjacent channels 54 and 56 which define the outer periphery of each projection 58. As is readily apparent, each of the above-described embodiments of the invention provides a clearly enhanced and improved recoil pad that combines both the inherent energy absorbing characteristics of the previously described elastomer material with an overall matrix geometry that takes specific advantage of the material characteristics of the elastomer material by allowing the material to expand or bulge normally of the direction of recoil loading into numerous relief areas spread about the user facing surface of the matrix.

Figure 9:
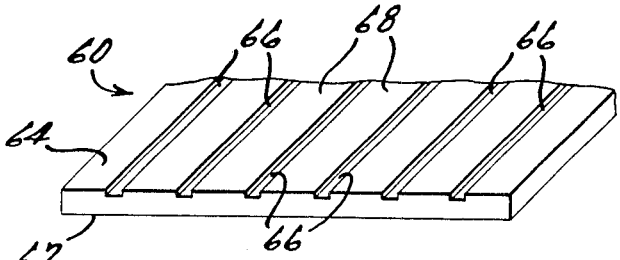
FIG. 9 is a partial perspective view of a further embodiment of the invention.

An alternate embodiment of a matrix geometry exhibiting characteristics and advantages similar to the embodiment of FIGS. 7 and 8 is shown in FIG. 9. In this regard, FIG. 9 illustrates an alternate form of an internal solid elastomer matrix 60 formed to define a top surface of 62 and a user facing surface 64. Th user facing surface 64 of the matrix 60 is formed with a plurality of spaced parallel longitudinally extending recesses or channels 66 of generally rectangular cross-section extending from surface 64 and into the interior of the matrix 60. The channels 66 cooperatively define a relief grid extending along surface 64, and a series of longitudinally extending projections 68 disposed between respective channels 66. With this overall geometry, the matrix material disposed within each projection 68 possesses the ability to expand or bulge normally of the direction of impact loading placed upon the matrix 60 and into the volumes defined by each channel 66.

Figure 12:
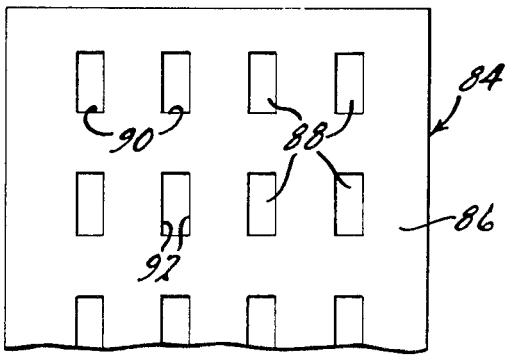
FIG. 12 is a schematic view of a portion of still another embodiment of the invention.
Figure 13:
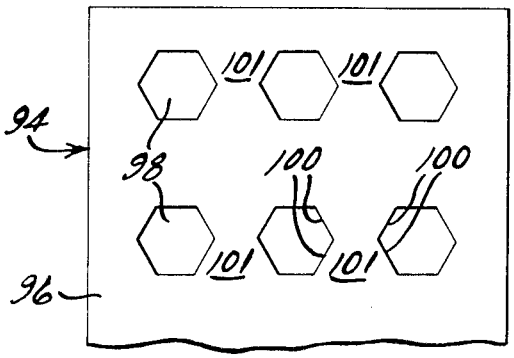
FIG. 13 is a schematic view of a portion of a further embodiment of the invention.
Figure 14:
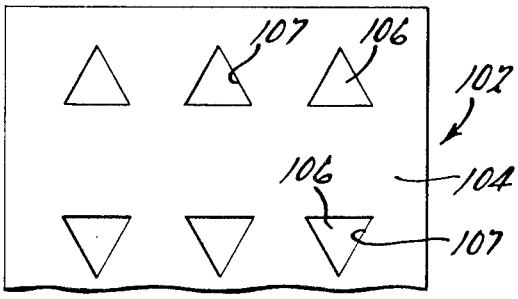
FIG. 14 is a schematic view of a portion of another embodiment of the invention.
Figure 15:
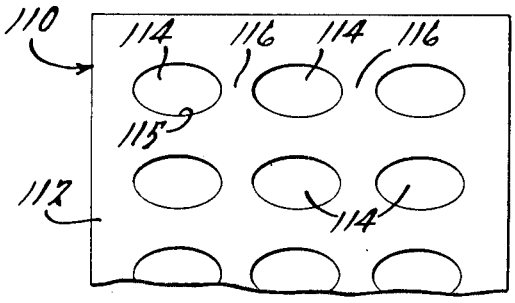
FIG. 15 is a schematic view of a portion of yet another embodiment of the invention.

Additional embodiments of the invention exhibiting characteristics and advantages of the embodiment in FIGS. 5 and 6 are shown in FIGS. 10 through 15. The embodiment illustrated in FIG. 10 includes a solid elastomer matrix 70 having a user facing surface 72 formed with a plurality of periodically spaced recesses 74 of circular cross-section. Each recess 74 encompasses a volume defined by a cylindrical sidewall 75 and into which portions of the matrix 70 are operative to expand or bulge in response to a firearm impact load. The embodiment of the invention illustrated in FIG. 11 comprises a solid elastomer matrix 76 having a user facing surface 78 formed with a plurality of periodically spaced star-shaped recesses 80 extending from surface 78 and into the matrix 76. The presence of each of the star-shaped recesses 80 enables portions 82 of the matrix 76 to expand or bulge in a direction normal to impact loads placed upon the matrix 76 and into each of the recesses 80. FIG. 12 illustrates an alternate embodiment which includes an elastomer matrix 84 defining a user facing surface 86 formed with a plurality of generally elongated rectangular recesses 88 extending therefrom and into the matrix 84. Each of the rectangular recesses 88 is defined by spaced parallel sidewalls 90 and 92, and portions of the matrix 84 disposed adjacent each of the sidewalls 90 and 92 possesses the ability to bulge or expand into the associated recess 80 for absorbing impact loads in the previously described manner. FIG. 13 illustrates an internal matrix 94 defining a user facing surface 96 formed with a plurality of periodically spaced hexagonal recesses 98. Each of the hexagonal recesses 98 is defined by sidewalls 100, and portions 101 of the matrix 94 disposed adjacent each sidewall 100 possess the ability to expand or bulge into recesses 98 under impact loading placed upon the matrix 94. The embodiment illustrated in FIG. 14 includes an internal matrix 102 having a user facing surface 104 formed with a plurality of periodically spaced triangular recesses 106 defined by sidewalls 107. As is readily apparent, portions of the matrix 102 disposed adjacent sidewalls 107 are operative to expand or bulge into recesses 106 in the previously described manner. The embodiment illustrated in FIG. 15 includes an internal matrix 110 having a user facing surface 112 formed with a plurality of elliptical recesses 114 defined by cylindrically shaped sidewalls 115. As shown in FIG. 15, portions 116 of matrix 110 disposed adjacent associated sidewalls 115 are operative to expand into recesses 114 to assist in absorbing impact loads. In each of the embodiments illustrated in FIGS. 9 through 15, the depth of each of the channels or recesses 66, 74, 80, 88, 98, 106 and 114 are preferably less than one half the overall thickness of the associated matrices.

Alternatively, it should be noted that in applications utilizing solid polyurethane elastomer matrices having durometer values of from approximately 35 to approximately 80 on the 00-Shore durometer scale, or from 0 to approximately 20 on the A-Shore durometer scale, the recesses such as shown in FIG. 5 at 46, and in FIGS. 10 through 15 at 74, 80, 88, 98, 106 and 114, can be replaced by similarly shaped through apertures or channels extending through the thickness of the matrix. Such through channels or apertures can be provided in the matrix by way of a punching operation, and are operative to give the matrix material located adjacent to such apertures the ability to expand or bulge in the direction generally normal of the direction of impact loading placed upon the matrix during firearm use to provide the matrix with additional modes of deformation for absorbing recoil forces in the previously described manner.

Figure 16:
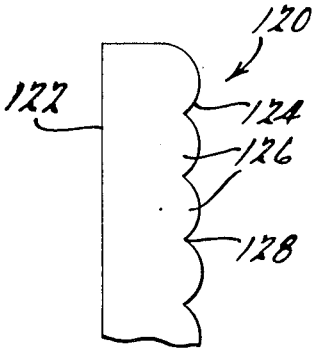
FIG. 16 is a side elevational view of a portion of yet another embodiment of the invention.

FIG. 16 illustrates a partial side elevational view of yet another embodiment of the invention. More particularly, this embodiment of the invention utilizes an internal solid elastomer matrix 120 having a top surface 122 and a user facing surface 124 formed to define a plurality of laterally extending spaced parallel ribs 126. Each of the ribs 126 is generally semi-circular in cross-section, and each set of adjacent ribs 126 effectively defines a laterally extending recess or channel 128 disposed along surface 124 in the manner shown in FIG. 16. Portions of the matrix 120 disposed within each rib 126 are operative to expand or bulge into recesses or channels 128 under the influence of an impact load placed upon the matrix 120. In the preferred form of this embodiment of the invention, the overall height of each of ribs 126 is approximately one half of the overall thickness of the matrix 120. Thus, for example, in applications utilizing an internal matrix 120 of approximately one half inch in overall thickness, the height of each of ribs 126 would be approximately one quarter inch. In addition to the above, it should also be noted that the intrnal matrix 120 of this embodiment can be provided with an additional set of ribs 126 on the opposite top surface 122 in applications where the provision of additional modes of deformation and thus enhanced recoil absorption are desired. Moreover, in applications utilizing polyurethane elastomers of higher durometer values, the internal matrix 120 can also be provided with recesses and/or through apertures or channels of the previously-described type extending through the thickness of the matrix 120. The ribs 126 themselves can be formed upon surface 124 and/or surface 122 by applying a waffle iron thereto.

Figure 17:
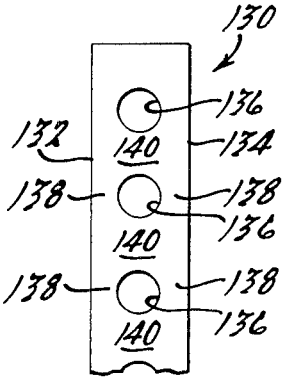
FIG. 17 is a side elevational view of a portion of a further embodiment of the invention.

Yet another embodiment of the present invention incorporating the principles and advantages thereof in a slightly different manner is illustrated in FIG. 17. This embodiment of the invention includes an internal solid elastomer matrix 130 defining generally parallel opposed outer faces 132 and 134, and having a plurality of periodically spaced non-communicating internal compression channels 136 which extend laterally along the matrix 130 in a direction substantially parallel to the outer faces 132 and 134. As so formed, portions 138 of the matrix 130 disposed adjacent each channel 136 are operative to bulge generally in the direction of a firearm impact load into channels 136, and portions 140 disposed laterally of and adjacent to particular channels 136 are operative to expand or bulge in a direction generally normal to the direction of impact load into channels 136. The matrix 130 of this embodiment can be formed through a molding process by situating solid rods within an appropriately configured mold. The rods can thereafter be removed to yield channels 136. While the cross-sectional shape of each channel 136 shown in FIG. 17 is generally circular, other channel shapes can be provided by using mold rods of other configurations.

Figure 18:
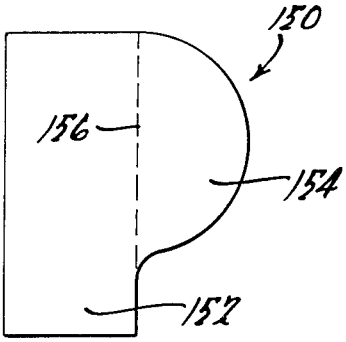
FIG. 18 is a schematic view of another embodiment of the invention.

FIG. 18 illustrates an alternate embodiment of a shoulder protection device 150 which includes a generally rectangular pad portion 152 similar in design and construction to the previously described device 10, as well as an auxiliary pad 154 extending laterally of pad portion 152. The auxiliary pad 154 is operative to extend out over the ball of a user's shoulder, and facilitates the provision of additional firearm recoil protection for those firearm shooters who improperly position firearms relative to their shoulder. In this embodiment of the invention, each of the pad portions 152 and 154 can be provided with an internal solid elastomer matrix contained within an internal flexible envelope similar to envelope 30. Alternatively, each of the pad portions 152 and 154 can be provided in a form which does not require the provision of an internal envelope such as envelope 30, such as in applications utilizing the previously described Eura-Lite elastomer. Moreover, portions 152 and 154 can be formed as two distinct portions, or as one single piece with pad portion 154 depending from portion 152. Each of the pad portions 152 and 154 are operative to be retained within an external envelope similar to envelope 14. The device 150 can be provided in a form which includes a comfort flex folding seam 156 in the external envelope that provides the device 150 with ability to be flexed and folded to conform to a user body geometry as needed.

It is understood that the foregoing description is that of the preferred embodiment of the invention and that various changes and modifications may be made thereto without departing from the spirit and scope of the invention, as defined in the appended claims.

What is claimed is:

1. A shoulder protection device having a cover portion, and an energy absorbing pad carried within said cover portion and comprising a lightweight resilient soft polyurethane elastomer solid internal matrix for absorbing and dissipating recoil forces generated during the dischargeof a firearm.

2. The invention according to claim 1 wherein said polyurethane elastomer of said solid internal matrix has a specific gravity range of from approximately 1.02 to approximately 1.03, and has an elongation range of from approximately 300 percent to approximately 1,200 percent.

3. The invention according to claim 1 wherein said polyurethane elastomer of said solid internal matrix has a Shore durometer 00-scale value of from approximately 15 to approximately 35.

4. The invention according to claim 1 wherein said polyurethane elastomer of said solid internal matrix has a specific gravity of approximately 1.033, a hardness of approximately 20 durometer on the Shore 00-scale, and an elongation range of from approximately 565 percent to approximately 590 percent.

5. The invention according to claim 1 wherein said polyurethane elastomer of said solid internal matrix has a Shore durometer A-scale value of from 0 to approximately 20, and is formed with a plurality of discrete non-communicating through apertures formed therein.

6. The invention according to claim 5 wherein said solid internal matrix possesses a thickness dimension in the direction of recoil loading of said pad, and said through apertures extend generally in the direction of said thickness dimension.

7. The invention according to claim 1 wherein said polyurethane elastomer of said solid internal matrix has a Shore durometer 00-scale value of from approximately 35 to approximately 80.

8. The invention according to claim 7 wherein said solid internal matrix possesses a thickness dimension in the direction of recoil loading of said pad, and said through apertures extend generally in the direction of said thickness dimension.

9. The invention according to claim 1 wherein said solid internal matrix defines a user facing surface having a plurality of recesses extending therefrom and into said matrix.

10. The invention according to claim 9 wherein said polyurethane elastomer of said solid internal matrix has a Shore durometer 00-scale value of from approximately 20 to approximately 35.

11. The invention according to claim 9 wherein said soid internal matrix possesses a thickness dimension in the direction of recoil loading of said pad, and said recesses have a depth which is less than one half of said thickness dimension.

12. The invention according to claim 9 wherein said recesses are spaced along said user facing surface in a periodic fashion.

13. The invention according to claim 9 wherein said recesses are generally rectangular in cross-section.

14. The invention according to claim 9 wherein said recesses are generally circular in cross-section.

15. The invention according to claim 9 wherein said recesses are generally star-shaped in cross-section.

16. The invention according to claim 9 wherein said recesses are generally triangular in cross-section.

17. The invention according to claim 9 wherein said recesses are generally hexagonal in cross-section.

18. The invention according to claim 9 wherein said recesses possess a polygonal cross-sectional shape.

19. The invention according to claim 9 wherein said recesses are generally elliptical in cross-section.

20. The invention according to claim 9 wherein said plurality of recesses comprise a first series of spaced parallel elongated channels extending along said user facing surface.

21. The invention according to claim 20 wherein said channels are rectangular in cross-section.

22. The invention according to claim 20 wherein said plurality of recesses further comprise a second series of spaced parallel elongated channels extending along said user facing surface and which intersect said first series of parallel elongated channels.

23. The invention according to claim 22 wherein said first and second series of parallel elongated channels cooperatively define a diamond shaped relief grid along said user facing surface.

24. The invention according to claim 1 wherein said solid internal matrix defines a firearm surface, a user facing surface, and a thickness dimension in the direction of recoil loading of said pad and extending between said firearm facing surface and said user facing surface, with said solid internal matrix being formed with at least one elongated compression chamber extending within said solid internal matrix between said user facing surface and said firearm facing surface.

25. The invention according to claim 24 wherein each said compression chamber extends within said solid internal matrix generally perpendicularly of said thickness dimension.

26. The invention according to claim 24 wherein said solid internal matrix is formed with a plurality of said compression chambers extending substantially parallel of one another within said matrix.

27. The invention according to claim 24 wherein each said compression chamber is generally circular in cross-section.

28. The invention according to claim 1 wherein said solid internal matrix is formed to define a user facing surface, and a first series of raised elongated ribs extending along said user facing surface and substantially parallel of one another.

29. The invention according to claim 1 wherein said solid internal matrix is carried within a sealed flexible internal envelope retained within said cover portion.

30. The invention according to claim 29 wherein said internal envelope is defined by a pair of opposing flexible thin sheets matingly secured to one another adjacent their respective outer peripheral edges.

31. The invention according to claim 30 wherein said internal envelope comprises a pair of thin flexible sheets of plastic film matingly assembled to each other adjacent their respective outer peripheral edges by a heat sealing process.

32. The invention according to claim 1 wherein said cover portion is formed from a flexible cloth fabric.

33. The invention according to claim 1 wherein said cover portion is formed from a single elongated piece of flexible material folded upon itself and matingly assembled along its longitudinal edges to define an external envelope having a front face and a back face and within which said solid internal matrix is retained.

34. The invention according to claim 1 wherein said cover portion defines a closed external envelope within which said solid internal matrix is carried and a tongue portion depending from said external envelope and having means for attaching said device to a portion of the garment of a user.

35. The invention according to claim 1 wherein said energy absorbing pad is substantially rectangular in shape, and said device further comprises an auxiliary solid polyurethane elastomer pad portion retained within said cover portion laterally adjacent said energy absorbing pad and operative to extend over the ball of a user's shoulder.

36. The invention according to claim 1 wherein said energy absorbing pad defines a firearm facing surface, a user facing surface, and a thickness dimension in the direction of recoil loading of said pad and extending between said firearm facing surface and said user facing surface, with said thickness dimension being between approximately $\frac{1}{8}$ and approximately $\frac{3}{4}$ inches.

* * * * *